US007121866B2

(12) United States Patent
Testa et al.

(10) Patent No.: US 7,121,866 B2
(45) Date of Patent: Oct. 17, 2006

(54) ELECTRIC CONNECTER

(75) Inventors: Davide Testa, Montanaro (IT); Fausto Girard, Turin (IT)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/523,625

(22) PCT Filed: Aug. 5, 2003

(86) PCT No.: PCT/EP03/08656

§ 371 (c)(1),
(2), (4) Date: Dec. 5, 2005

(87) PCT Pub. No.: WO2004/015820

PCT Pub. Date: Feb. 19, 2004

(65) Prior Publication Data

US 2006/0116018 A1 Jun. 1, 2006

(30) Foreign Application Priority Data

Aug. 6, 2002 (IT) ..... TO2002A0701

(51) Int. Cl.
*H01R 13/627* (2006.01)

(52) U.S. Cl. ..... 439/347; 439/157

(58) Field of Classification Search ..... 439/347, 439/157, 372

See application file for complete search history.

(56) References Cited

U.S. PATENT DOCUMENTS 4,981,440 A * 1/1991 Werner et al. ..... 439/266
5,681,175 A * 10/1997 Busse et al. ..... 439/157
5,823,807 A 10/1998 Yamasaki et al. ..... 439/157
5,876,226 A * 3/1999 Tsukakoshi et al. ..... 439/157
5,928,012 A * 7/1999 Kitamura ..... 439/157
6,168,445 B1 * 1/2001 Seutschniker et al. ..... 439/157
6,213,795 B1 * 4/2001 Drescher et al. ..... 439/157
6,217,354 B1 * 4/2001 Fencl et al. ..... 439/157
6,305,957 B1 * 10/2001 Fink et al. ..... 439/157
6,309,242 B1 10/2001 Ohtaka et al. ..... 439/489
6,315,585 B1 * 11/2001 Oka ..... 439/157
6,345,995 B1 * 2/2002 Bigotto et al. ..... 439/157
6,361,334 B1 * 3/2002 Konoya et al. ..... 439/144
6,361,337 B1 * 3/2002 Kurimoto ..... 439/157
6,361,356 B1 * 3/2002 Heberlein et al. ..... 439/489
6,375,481 B1 * 4/2002 Zweigle ..... 439/157

(Continued)

FOREIGN PATENT DOCUMENTS

EP 1 005 112 A2 5/2000

(Continued)

*Primary Examiner*—Ross Gushi
(74) *Attorney, Agent, or Firm*—Harrington & Smith,LLP

(57) ABSTRACT

There is described an electric connector (2) having an insulating casing (4) defining a number of cavities housing respective electric terminals and having axes parallel to a first direction (A) in which the connector (2) is coupled to a complementary connector (3); a slide (16) fitted to the casing (4) to slide in a second direction (B) perpendicular to the first direction (A), and having first cam coupling members (19) receiving respective second coupling members (20) on the complementary connector (3) to produce a relative coupling movement between the connectors (2, 3) in the first direction (A) when the slide (16) moves in the second direction (B); releasable retaining means (42, 43, 45, 47, 31, 32) defining a fully assembled position of the slide (16) to the casing (4); and elastic means (35) generating an elastic load on the complementary connector (3) being coupled to the casing (4), so as to expel the complementary connector (3), in the event the slide (16) fails to fully engage the casing (4).

11 Claims, 4 Drawing Sheets

U.S. PATENT DOCUMENTS

| | | | | |
|---|---|---|---|---|
| 6,641,423 | B1 * | 11/2003 | Giro | 439/347 |
| 6,652,298 | B1 * | 11/2003 | Ohnuki | 439/157 |
| 6,666,697 | B1 * | 12/2003 | Yamashita | 439/157 |
| 6,702,597 | B1 * | 3/2004 | Pade | 439/157 |
| 6,824,406 | B1 * | 11/2004 | Sharples et al. | 439/157 |
| 6,960,090 | B1 * | 11/2005 | Denter et al. | 439/157 |
| 6,971,894 | B1 * | 12/2005 | Dillon et al. | 439/157 |
| 6,997,725 | B1 * | 2/2006 | Stella et al. | 439/157 |
| 7,004,769 | B1 * | 2/2006 | Putnam et al. | 439/157 |
| 7,037,124 | B1 * | 5/2006 | Lee et al. | 439/157 |
| 2001/0021599 | A1 * | 9/2001 | Kurimoto | 439/157 |
| 2001/0021600 | A1 * | 9/2001 | Kurimoto | 439/157 |
| 2002/0072261 | A1 * | 6/2002 | Pade | 439/157 |
| 2002/0081877 | A1 * | 6/2002 | Ohnuki | 439/157 |
| 2003/0082940 | A1 * | 5/2003 | Yamashita | 439/157 |
| 2003/0109155 | A1 * | 6/2003 | Yamashita | 439/157 |
| 2005/0020114 | A1 * | 1/2005 | Denter et al. | 439/157 |
| 2005/0064749 | A1 * | 3/2005 | Stella et al. | 439/157 |
| 2005/0106911 | A1 * | 5/2005 | Sharples et al. | 439/157 |

FOREIGN PATENT DOCUMENTS

| | | |
|---|---|---|
| EP | 1 005 112 A3 | 11/2000 |
| EP | 1 133 021 A2 | 9/2001 |
| EP | 1 133 021 A3 | 11/2002 |
| EP | 0 984 524 B1 | 5/2003 |

* cited by examiner

ELECTRIC CONNECTER

TECHNICAL FIELD

The present invention relates to an electric connector, and particularly, though not exclusively, to an electric plug connector connectable to a complementary electric socket connector to form an electric connecting unit with a large number of ways of the type used to connect an electric system to an electronic central control unit.

BACKGROUND ART

Connecting units of the above type are known, whose connectors comprise respective insulating casings defining respective numbers of cavities for housing mutually connectable male and female electric terminals respectively.

Connecting units of this type normally comprise a lever-and-slide coupling device, which, once the plug and socket connectors are brought together, is operated manually to couple the connectors with very little effort required.

The coupling device substantially comprises a slide fitted inside the plug connector casing to slide in a direction perpendicular to the coupling direction of the connectors; and an operating lever hinged to the same casing and fitted to the slide.

In one fairly commonly used embodiment, the slide is C-shaped and defined by an end wall perpendicular to the slide direction, and by two lateral walls extending perpendicularly from respective opposite end edges of the end wall, and which slide along relative lateral walls of the plug connector casing. Each lateral wall of the slide has a number of cam grooves engaged by respective outer pins on the plug connector to produce a relative engagement movement between the plug and socket connectors in the coupling direction when the slide moves in the slide direction.

The slide is normally retained by temporary locking means, e.g. releasable retaining members, in a preassembly position partly inserted inside the plug connector casing, and is moved into a full-insertion position inside the casing by rotating the operating lever from a raised to a lowered position about its hinge axis.

The lowered position of the lever, and consequently the full-insertion position of the slide, normally corresponds to complete coupling of the male and female terminals of the two connectors.

In the event one or more terminals are assembled wrongly inside the relative casings, however, the slide and lever may still be forced into the respective full-insertion and lowered positions, e.g. by breaking or deforming the contacting parts; in which case, the wrongly assembled terminals may escape detection during testing, e.g. because the position of the terminal is such as still to produce electrical contact, however precarious. In applications in which the connectors are subjected to vibration, as on vehicles, however, such contact is bound to be broken eventually, with all the obvious consequences this entails.

DISCLOSURE OF INVENTION

It is an object of the present invention to provide an electric connector designed to eliminate the aforementioned drawback typically associated with known connectors, and which, at the same time, is compact and cheap and easy to produce and assemble.

According to the present invention, there is provided an electric connector comprising an insulating casing defining a number of cavities housing respective electric terminals and having axes parallel to a first direction in which said connector is coupled to a complementary connector; a slide fitted to said casing to slide in a second direction perpendicular to said first direction, and having first cam coupling members receiving respective second coupling members on said complementary connector to produce a relative coupling movement between said connectors in said first direction when said slide moves in said second direction; and releasable retaining means defining a fully assembled position of said slide to said casing; characterized by also comprising elastic means generating an elastic load on the complementary connector being coupled to said casing, so as to expel the complementary connector, in the event said slide fails to fully engage said casing.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
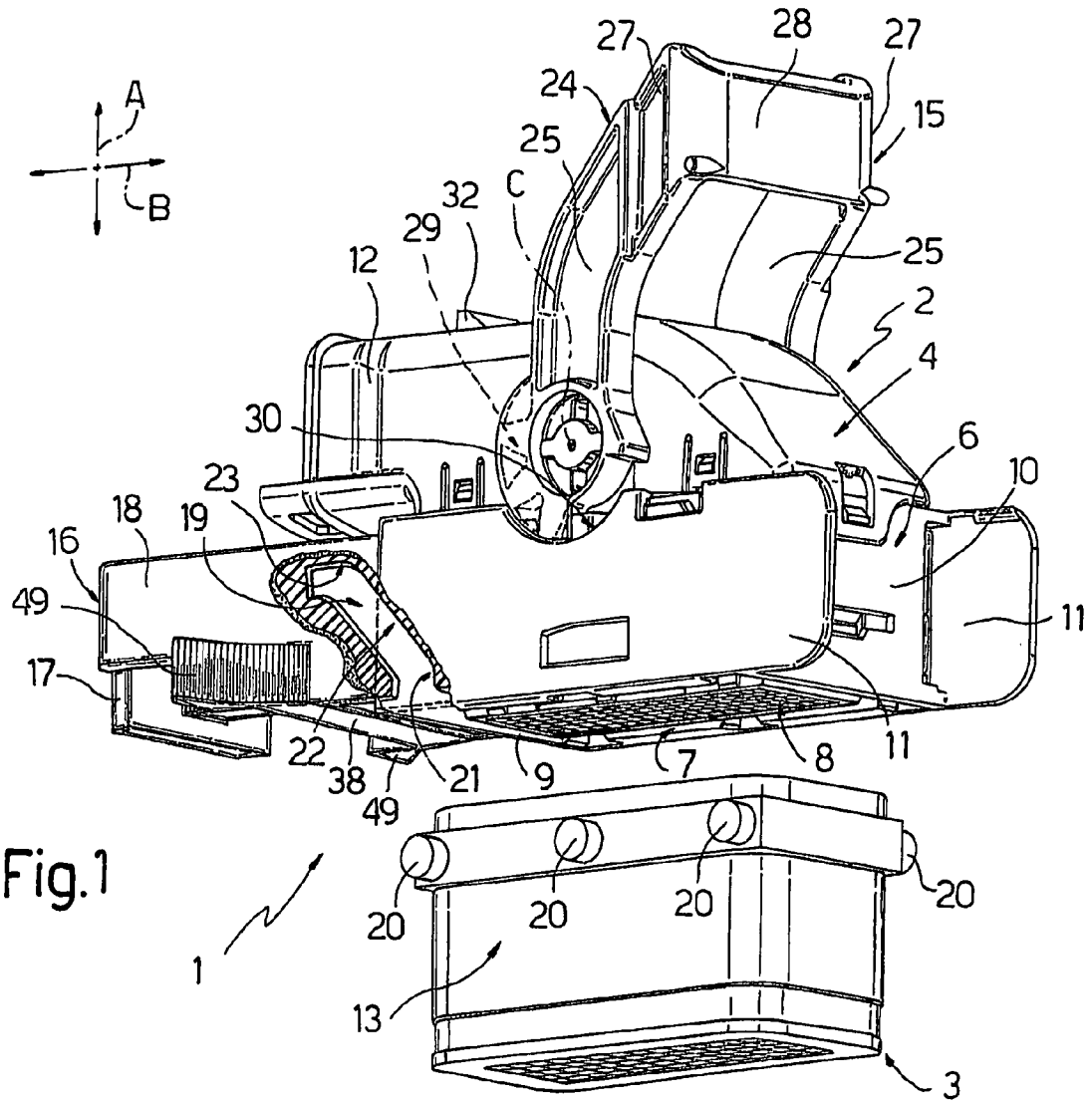
FIG. 1 shows an exploded view in perspective of an electric connecting unit defined by an electric plug connector in accordance with the present invention, and by a complementary electric socket connector.

Number 1 in FIG. 1 indicates as a whole an electric connecting unit with a large number of ways, in particular for connecting an electronic central control unit (not shown) to a vehicle electric system (not shown).

Figure 7:
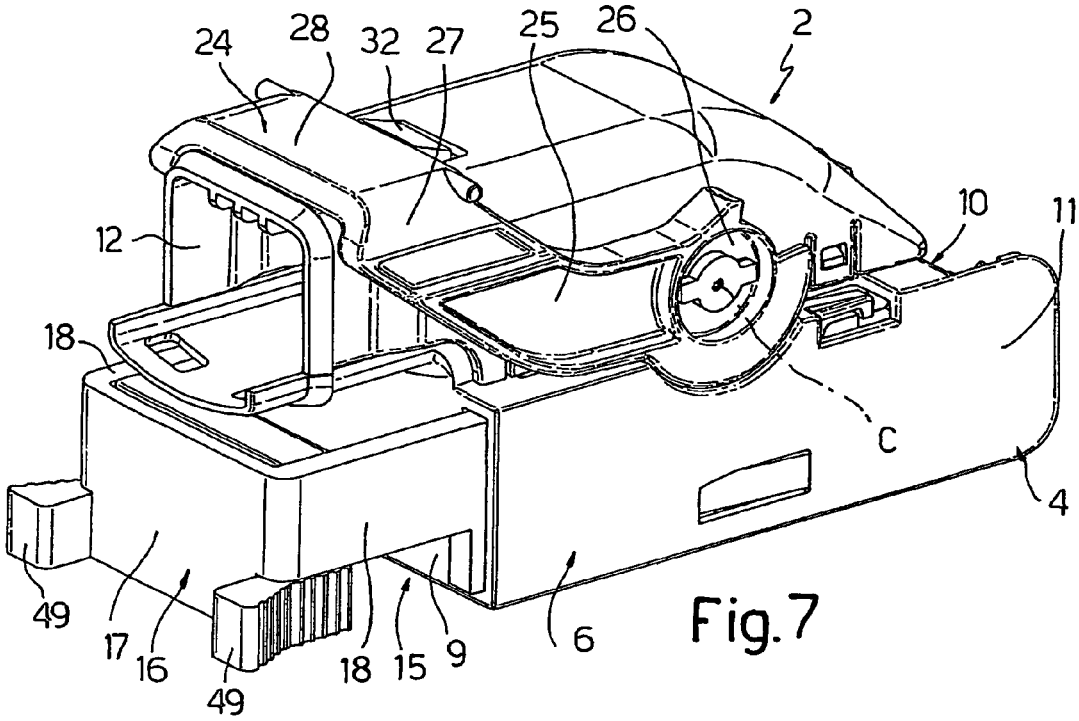
FIG. 7 shows a larger-scale view in perspective of the FIG. 1 electric plug connector in a further operating position.

Unit 1 comprises a first plug connector 2 (also shown in FIGS. 2, 4 and 7) and a second socket connector 3 connectable to each other in a direction A.

Connector 2 according to the present invention comprises an insulating casing 4 made of plastic material and defining a number of cavities (not shown) having axes parallel to direction A and housing respective known female electric terminals (not shown) fitted in known manner inside the cavities and connected to relative known electric cables (not shown).

Casing 4 comprises a hollow, substantially parallelepiped-shaped main body 6 defining an end opening 7, for insertion of connector 3, and fitted inside with a substantially parallelepiped-shaped block 8 for supporting the female terminals and in which said cavities are formed.

More specifically, main body 6 is defined by two, respectively front and rear, end walls 9, 10, and by two lateral walls 11 perpendicular to end walls 9, 10 and defining, with end walls 9, 10, opening 7 for receiving connector 3.

Casing 4 also comprises an outer shell 12 fitted to main body 6, on the opposite side to opening 7, and through which extends the electric cables for connection to the female terminals on block 8.

Connector 3, only described herein as required for a clear understanding of the present invention, comprises a hollow, substantially parallelepiped-shaped insulating casing 13 conveniently formed in one piece with the outer casing (not shown) of the electronic central control unit, and housing a number of known male electric terminals (not shown) extending parallel to direction A and connected to relative known electric cables (not shown). Casing 13 defines a cavity for receiving block 8 of connector 2, and inside which project respective contact portions of the male terminals.

Unit 1 also comprises a lever-and-slide coupling device 15 for coupling connectors 2 and 3 with a minimum amount of manual effort.

Coupling device 15 comprises a slide 16, which slides partly inside casing 4 and is movable with respect to casing 4 in a direction B perpendicular to direction A and to end walls 9, 10 of main body 6. Slide 16 is substantially C-shaped, and comprises an end wall 17 perpendicular to direction B and located outside casing 4, facing end wall 9 of main body 6; and two lateral walls 18 extending perpendicularly from respective opposite lateral edges of end wall 17 and parallel to directions A and B. Lateral walls 18 of slide 16 fit through respective lateral end openings (not shown) in end wall 9, and slide between block 8 and respective opposite lateral walls 11 of main body 6 of casing 4.

Main body 6, block 8, and lateral walls 18 of slide 16 define a cavity for receiving casing 13 of connector 3 and so defining a coupling region of connector 2 to connector 3.

Each lateral wall 18 comprises a number of cam grooves 19—in the example shown, three (only one of which is shown in FIG. 1)—which cooperate with respective cylindrical outer pins 20 on casing 13 to produce a relative coupling movement between connectors 2 and 3 in direction A, when slide 16 moves inwards of casing 4 in direction B.

More specifically, each groove 19 comprises a lead-in portion 21 for relative pin 20, extending parallel to direction A and located close to opening 7; an intermediate portion 22 sloping with respect to directions A and B; and an end portion 23 parallel to direction B and defining a stop for pin 20. Grooves 19 in each lateral wall 18 are open towards the other lateral wall 18, and are closed on the opposite side by a bottom surface.

Coupling device 15 also comprises an operating lever 24 hinged to casing 4 about an axis C perpendicular to directions A and B, and connected to lateral walls 18 of slide 16 so that rotation of lever 24 about axis C moves slide 16 in direction B and, by virtue of pins 20 engaging grooves 19, produces a relative coupling movement between connectors 2 and 3 and between the terminals of connectors 2 and 3 in direction A.

Lever 24 is defined by two contoured arms 25 having first end portions 26 hinged externally about axis C to opposite sides of shell 12 of casing 4, and second end portions 27 joined by a cross member 28.

Each end portion 26 is cylindrical, of axis C, and defines, on one side of the extension area of relative arm 25, a sector gear 29 defined, in the example shown, by three teeth, and which engages a rack 30 also defined by three teeth (not all shown) and formed on an intermediate portion of an end edge of a relative lateral wall 18 of slide 16 adjacent to shell 12.

To couple connectors 2 and 3, lever 24 is rotated—in a direction to move cross member 28 towards end wall 17 of slide 16 (anticlockwise in FIGS. 1 and 2)—from a raised position (FIGS. 1 and 2) corresponding to predetermined withdrawal of slide 16 from casing 4, to a lowered position secured to casing 4 (FIGS. 4 and 7) and corresponding to maximum insertion or full assembly of lateral walls 18 of slide 16 inside casing 4, and a final coupling position of connectors 2 and 3.

More specifically, the lowered position of lever 24 is defined by cross member 28 clicking onto a releasable retaining member 31 extending integrally from shell 12, on the opposite side of shell 12 to that connected to main body 6. More specifically, retaining member 31 is defined by an elastically flexible lance projecting from shell 12 in a direction parallel to direction B, and having, on its free end, a substantially triangular tooth for engaging cross member 28.

An important characteristic of the present invention is that connector 2 also comprises two garter springs 35 (only one shown in FIGS. 3, 5, 6 and 8), which are is interposed between end wall 9 of main body 6 of casing 4 and end wall 17 of slide 16, have respective axes parallel to direction B, and oppose the movement of slide 16 into the fully assembled position inside casing 4. In other words, when coupling connectors 2 and 3, springs 35 generate an elastic load on connector 3 to expel connector 3 in the event slide 16 fails to fully engage casing 4.

More specifically, each spring 35 is fixed at opposite ends inside respective seats 36, 37 (FIGS. 3, 5 and 6) formed respectively in end wall 17 of slide 16, and in a stop plate 38 interposed between end wall 17 and end wall 9 of main body 6 of casing 4, and secured to lateral walls 18 of slide 16 to slide in a direction parallel to direction B.

More specifically, plate 38 is substantially rectangular, and has, on opposite sides, respective projections 39 (only one shown in FIGS. 5 and 6) engaging respective rectangular slots 40 formed in lateral walls 18 of slide 16 and elongated in direction B. In the absence of external forces, springs 35 keep plate 38 in a forward position at a maximum distance from end wall 17 of slide 16, and in which projections 39 of plate 38 rest against respective end edges of slots 40 adjacent to casing 6 and extending parallel to direction A.

Plate 38 has a central, substantially rectangular through opening 41, through which extend two retaining lances or members 42, 43 projecting from respective end walls 17, 9 of slide 16 and casing 4, and which click onto each other to define the fully assembled position of slide 16 inside casing 4.

Figure 4:
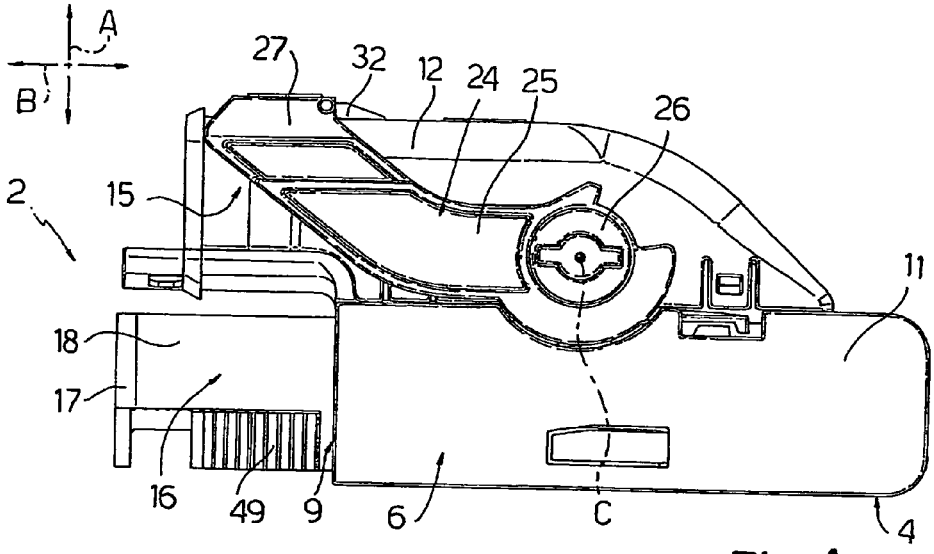
FIG. 4 shows a side view of the FIGS. 1 and 2 electric plug connector in a different operating position.
Figure 5:
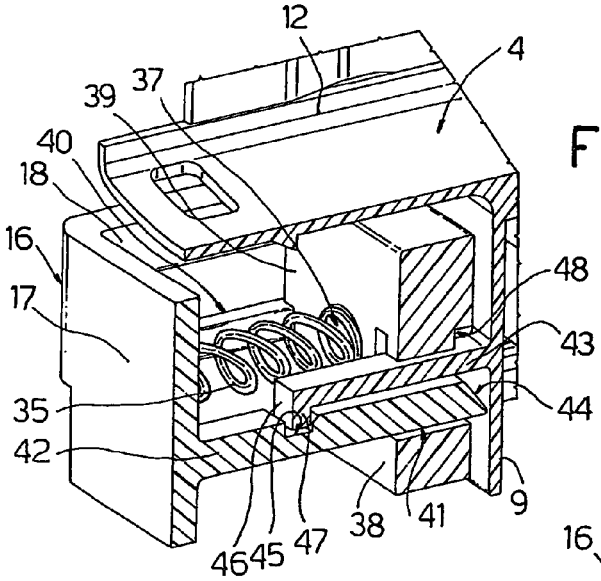
FIG. 5 shows a partly sectioned view in perspective of the FIG. 3 detail in the FIG. 4 operating position of the electric plug connector according to the invention.
Figure 8:
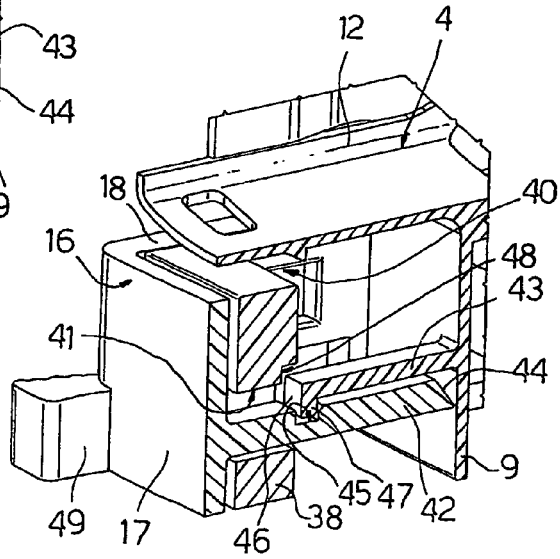
FIG. 8 shows a partly sectioned view in perspective of the FIG. 3 detail in the FIG. 7 operating position of the electric plug connector according to the invention.

More specifically, retaining member 42 comprises a ramp-shaped free end 44 for the purpose explained later on; and a substantially U-shaped recess 45 interposed between end 44 and end wall 17, and open at the sides and towards shell 12. Retaining member 43 is flexible elastically in a direction parallel to direction A, and supports, on its free end 46, a projecting pin 47, which releasably engages recess 45 of retaining member 42 to define the fully assembled position of slide 16 (FIGS. 4 and 5).

Figure 3:
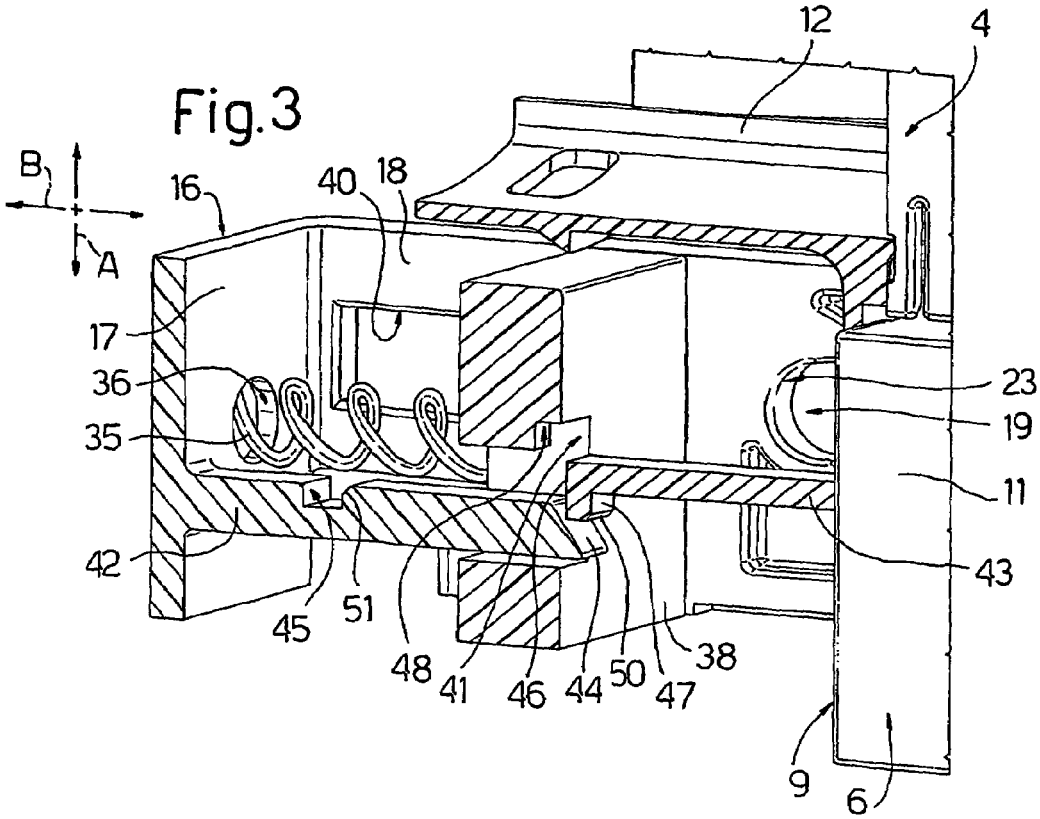
FIG. 3 shows a larger-scale, partly sectioned view in perspective of a detail of the electric plug connector in FIGS. 1 and 2.

As shown clearly in FIG. 3, pin 47 of retaining member 43 is located along the path of retaining member 42 towards casing 6 in direction B, so that, as slide 16 moves towards the fully assembled position, the ramp-shaped end 44 of retaining member 42 defines an upward-sloping surface, along which pin 47 of retaining member 43 slides to flex retaining member 43 towards shell 12 in direction A. Retaining member 43 is restored to the undeformed configuration when, as retaining members 42 and 43 slide with respect to each other as slide 16 moves inwards of casing 4, pin 47 eventually engages recess 45 of retaining member 42.

Along one side of the lateral edge of opening 41 facing shell 12, plate 38 defines a right-angle shoulder 48, against which the end 46 of retaining member 43 is arrested in the deformed configuration (FIG. 6), as slide 16 moves towards the fully assembled position. At this stage, retaining member 43 therefore acts as a pressure bar opposing the thrust of springs 35. Retaining member 43 is disengaged from shoulder 48 of plate 38 as pin 47 engages recess 45 of retaining member 42, and therefore as retaining member 43 is restored to the undeformed configuration.

In the fully assembled position of slide 16 (FIG. 5), plate 38, no longer opposed by retaining member 43 (FIG. 5), is pushed by springs 35 into a lock position, in which it is located adjacent to end wall 9 of main body 6 of casing 4, and is fitted through with both retaining members 42 and 43, which are thus maintained stably connected to each other. That is, engagement of retaining members 42 and 43 inside opening 41 of plate 38 prevents retaining member 43 from flexing in direction A and so releasing pin 47 from recess 45.

Plate 38 is provided on opposite sides with two tabs 49, which project outwards from lateral walls 18 of slide 16, and are operated manually to move plate 38, in opposition to springs 35, into a withdrawn position in which it is interposed between end wall 17 of slide 16 and recess 45, and so allows flexing of retaining member 43 in direction A to release pin 47 from recess 45.

To assist engagement and release of pin 47 and recess 45, these are provided, on the side facing end wall 9 of casing 4, with a lateral bevel 50 and a lead-in surface 51 respectively.

Figure 2:
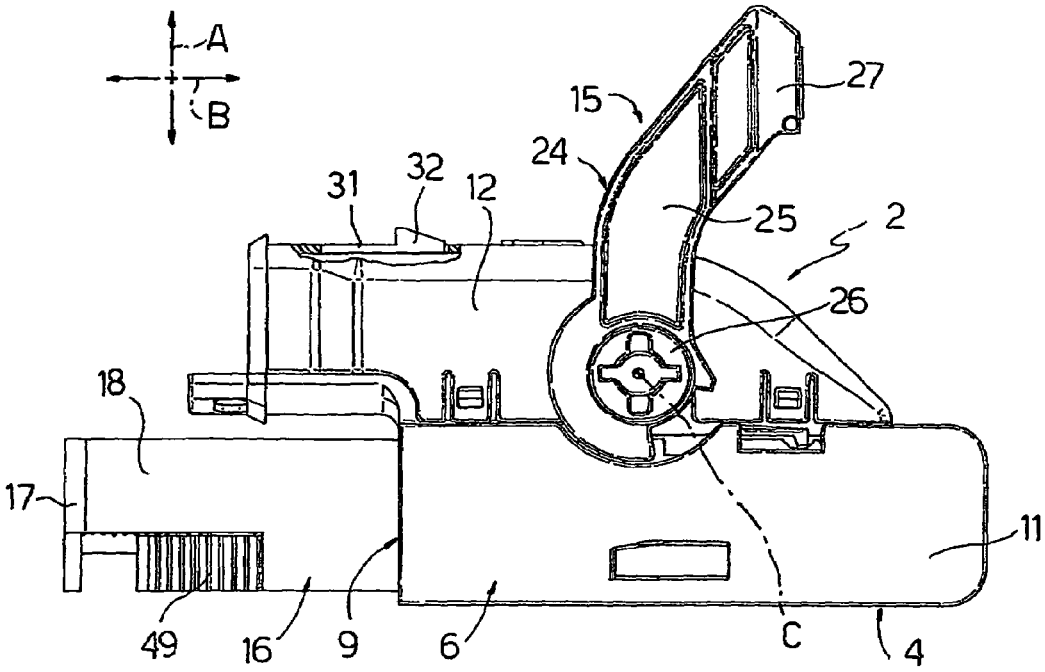
FIG. 2 shows a side view of the FIG. 1 electric plug connector.

Unit 1 is assembled by bringing connectors 2 and 3 together in direction A so that pins 20 engage lead-in portions 21 of respective grooves 19, and then rotating lever 24 from the FIGS. 1 and 2 raised position to the FIG. 4 lowered position.

More specifically, as it rotates, lever 24 moves slide 16 in direction B by sector gear 29 engaging rack 30; and the relative sliding movement between pins 20 and sloping intermediate portions 22 of relative grooves 19 gradually couples connectors 2 and 3 in direction A.

Figure 6:
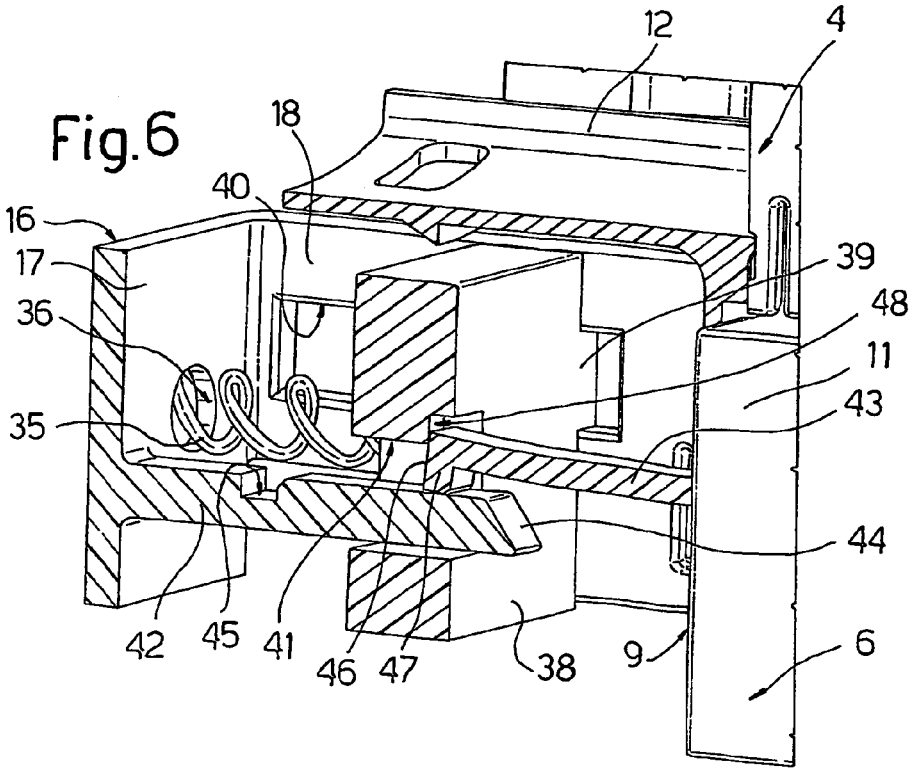
FIG. 6 shows a partly sectioned view in perspective of the FIG. 3 detail moving into the FIG. 5 position.

With particular reference to FIGS. 3 and 6, as slide 16 begins moving inwards of casing 4, pin 47 of retaining member 43 contacts and slides along ramp-shaped end 44 of retaining member 42, thus flexing retaining member 43 towards shell 12 and towards the edge portion of opening 41 on which shoulder 48 is formed; and the flexed retaining member 43 is arrested with its free end 46 against shoulder 48 of plate 38.

As lever 24 continues rotating into the lowered position, thus gradually engaging slide 16 inside casing 4, slide 16 slides with respect to plate 38, which is locked in position and prevented from moving by retaining member 43, so that springs 35 are compressed between the stationary plate 38 and the end wall 17 of slide 16 moving towards casing 4.

At this stage, retaining member 42 slides in direction B along pin 47 of retaining member 43 to bring recess 45 up to pin 47.

At this point, pin 47 clicks into recess 45, thus releasing plate 38, which is pushed by springs 35 along slots 40 in lateral walls 18 of slide 16 into the lock position adjacent to end wall 9 of main body 6 of casing 4 (FIG. 5).

At the same time, connectors 2 and 3 reach the final coupling position, and lever 24 is locked in the lowered position by cross member 28 clicking onto tooth 32 of retaining member 31.

In this configuration, the lateral edge of opening 41 in plate 38 surrounds retaining members 42 and 43, to prevent any relative movement between them in direction A, and so prevent release of pin 47 from recess 45.

In the event of failure to rotate lever 24 fully into the lowered position, and so insert slide 16 fully inside casing 4, springs 35 expand, upon release of lever 24, to push slide 16 outwards and, by virtue of pins 20 engaging grooves 19, expel connector 3, thus enabling immediate detection of the anomaly by the operator.

Connectors 2 and 3 are disconnected by acting on plate 38 to move it, in opposition to springs 35, into the withdrawn position adjacent to end wall 17 of slide 16, and by simultaneously rotating lever 24 into the raised position after first releasing it from retaining member 31.

More specifically, plate 38 is moved with respect to slide 16 using tabs 49. And, once plate 38 is in the withdrawn position, retaining member 43 is free to flex in a direction parallel to direction A to release pin 47 from recess 45 of retaining member 42, which is done by simply moving lever 24 from the lowered to the raised position, and is assisted by bevel 50 of pin 47 interacting with lead-in surface 51 of recess 45.

The advantages of connector 2 according to the present invention will be clear from the foregoing description.

In particular, when assembling unit 1, the elastic load exerted by springs 35 on coupling device 15, and therefore on connector 3, provides for expelling connector 3 in the event of incomplete travel of lever 24 and slide 16 caused, for example, by improper assembly of one or more terminals inside the respective cavities, thus enabling any anomaly in the coupling of connectors 2 and 3 to be detected immediately.

Moreover, locating springs 35 outside the area of interaction between connectors 2 and 3 simplifies assembly and molding of the parts to be fitted one inside the other.

Finally, locating springs 35 outside casing 4, and more specifically between casing 4 and slide 16, reduces the overall size of connector 2 by limiting the small increase in stickout of slide 16 to the area from which the electric cables project.

Clearly, changes may be made to connector 2 as described herein without, however, departing from the scope of the present invention.

In particular, recess 45 and pin 47 may be associated with casing 4 and slide 16 respectively, and the elastically flexible retaining member may extend from end wall 17 of slide 16.

The invention claimed is:

1. An electric connector comprising an insulating casing defining a number of cavities housing respective electric terminals and having axes parallel to a first direction in which said connector is coupled to a complementary connector; a slide fitted to said casing to slide in a second direction perpendicular to said first direction, and having first cam coupling members receiving respective second coupling members on said complementary connector to produce a relative coupling movement between said connectors in said first direction when said slide moves in said second direction; and releasable retaining means defining a fully assembled position of said slide to said casing; characterized by also comprising elastic means generating an elastic load on the complementary connector being coupled to said casing, so as to expel the complementary connector, in the event said slide fails to fully engage said casing.

2. A connector as claimed in claim 1, characterized in that said elastic means are interposed between respective facing walls of said slide and said casing.

3. A connector as claimed in claim 2, characterized in that said releasable retaining means comprise retaining means between said slide and said casing, and which are activated upon said slide reaching said fully assembled position.

4. A connector as claimed in claim 3, characterized in that said retaining means comprise at least one seat and a pin, which are associated with said walls and are mutually engaged in said fully assembled position of said slide; at least one of said seat and said pin being carried by a pressure member opposing the thrust of said elastic means as said slide moves towards said fully assembled position.

5. A connector as claimed in claim 4, characterized in that said elastic means comprise at least one elastic member varying in length in said second direction and fixed between one of said walls and a movable member interposed between said walls and connected to said slide to slide in said second direction; and in that said pressure member is carried by the other of said walls, and cooperates with said movable member to counteract the thrust of said elastic member as said slide moves towards said fully assembled position.

6. A connector as claimed in claim 5, characterized in that said pressure member comprises an elastically flexible lance projecting from said other of said walls in said second direction, and movable, as said slide moves towards said fully assembled position, between a deformed configuration, in which it cooperates with said movable member to counteract the thrust of said elastic member, and an undeformed configuration, in which it releases said movable member, and which is produced by said pin engaging said seat.

7. A connector as claimed in claim 6, characterized in that, in said fully assembled position of said slide, said movable member is maintained by said elastic member in a lock position preventing deformation of said elastically flexible lance and release of said pin from said seat; said movable member being movable, in opposition to said elastic member, into an enabling position enabling flexing of said elastically flexible lance and release of said pin from said seat.

8. A connector as claimed in claim 6, characterized in that said pin projects from a free end of said elastically flexible lance; and in that said seat comprises a recess formed on a further lance projecting in said second direction from said one of said walls, cooperating in sliding manner with said elastically flexible lance as said slide moves towards said fully assembled position, and having a ramp-shaped free end for flexing said elastically flexible lance.

9. A connector as claimed in claim 8, characterized in that said movable member comprises a plate parallel to said walls, having an opening engageable by said lances, and defining, along one side of the lateral edge of said opening, a shoulder against which said elastically flexible lance rests in said deformed configuration.

10. A connector as claimed in claim 1, characterized in that said casing comprises a hollow body for connection to said complementary connector; and in that said slide is at least partly engaged inside said hollow body to slide in said second direction; said walls being defined by respective end walls, perpendicular to said second direction, of said slide and said hollow body.

11. A connector as claimed in claim 10, characterized in that said slide is substantially C-shaped, and comprises two lateral walls, which extend perpendicularly from the end wall of the slide, slide through said end wall of said hollow body, have said first cam coupling members, and have respective slots elongated in said second direction and engaged in sliding manner by respective lateral portions of said movable member.

* * * * *